US011292119B2

(12) United States Patent
Nishihara

(10) Patent No.: US 11,292,119 B2
(45) Date of Patent: Apr. 5, 2022

(54) HAND-HELD MEMBER AND HAND-HELD-TYPE ARTICLE

(71) Applicant: KYOCERA Corporation, Kyoto (JP)

(72) Inventor: Takanori Nishihara, Takatsuki (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 17/262,428

(22) PCT Filed: Jul. 23, 2019

(86) PCT No.: PCT/JP2019/028789
§ 371 (c)(1),
(2) Date: Jan. 22, 2021

(87) PCT Pub. No.: WO2020/022314
PCT Pub. Date: Jan. 30, 2020

(65) Prior Publication Data

US 2021/0245355 A1 Aug. 12, 2021

(30) Foreign Application Priority Data

Jul. 24, 2018 (JP) ..... JP2018-138722

(51) Int. Cl.
*B25G 1/10* (2006.01)

(52) U.S. Cl.
CPC ..... *B25G 1/102* (2013.01)

(58) Field of Classification Search
CPC . B25G 1/105; B25G 1/00; B25G 1/10; B25G 1/10; B25G 1/102; B25G 1/01; B25G 1/12; B65D 25/20; B65D 25/22; B65D 25/24; B26B 3/00; A47G 23/0216; A47G 23/02; A47G 23/00
See application file for complete search history.

(56) References Cited

U.S. PATENT DOCUMENTS 3,207,461 A * 9/1965 Metzler ..... A47G 23/0216 248/145.3
4,007,527 A * 2/1977 Tibbs ..... A47J 43/287 30/327

(Continued)

FOREIGN PATENT DOCUMENTS

JP S62-159854 U 10/1987
JP 3083652 U 2/2002

(Continued)

OTHER PUBLICATIONS

Decision to Grant a Patent for the related JP application 2020-500669 dated Aug. 18, 2020, 4 pages.

(Continued)

*Primary Examiner* — Robert J Scruggs
(74) *Attorney, Agent, or Firm* — Procopio Cory Hargreaves and Savitch LLP

(57) ABSTRACT

A hand-held member includes: a hand-held part main body; and a covering material that includes a resin material having viscoelasticity in a temperature range of 10 to 40° C. and covers the hand-held part main body. A hand-held-type article includes: the hand-held member described above; and a main body that is joined adjacent to the hand-held member and functions when the hand-held member is gripped.

4 Claims, 5 Drawing Sheets

(56) References Cited

U.S. PATENT DOCUMENTS

| | | | | | |
|---|---|---|---|---|---|
| 4,167,811 | A * | 9/1979 | Barrett | B26B 1/04 | 30/161 |
| 5,490,631 | A * | 2/1996 | Iioka | B29C 44/04 | 229/403 |
| 5,819,594 | A * | 10/1998 | Sjovall | B62K 21/26 | 74/551.9 |
| 2006/0243868 | A1* | 11/2006 | Nakamura | G02B 6/3636 | 248/113 |
| 2007/0148409 | A1 | 6/2007 | Rios et al. | | |
| 2010/0183814 | A1 | 7/2010 | Rios et al. | | |
| 2015/0217439 | A1* | 8/2015 | Miyawaki | B25G 3/02 | 30/517 |
| 2016/0084603 | A1* | 3/2016 | Michal | F41A 35/00 | 42/94 |
| 2020/0406011 | A1* | 12/2020 | Rule | B32B 7/06 | |
| 2021/0130566 | A1* | 5/2021 | Tseng | C08J 9/28 | |

FOREIGN PATENT DOCUMENTS

| | | | |
|---|---|---|---|
| JP | 2003019064 | * | 1/2003 |
| JP | 2003-049898 | A | 2/2003 |
| JP | 2003-080163 | A | 3/2003 |
| JP | 2004-358069 | A | 12/2004 |
| JP | 2006-002338 | A | 1/2006 |
| JP | 2007-099332 | A | 4/2007 |
| JP | 2009-057073 | A | 3/2009 |
| JP | 2014-186166 | A | 10/2014 |
| JP | 2017-226478 | A | 12/2017 |

OTHER PUBLICATIONS

Notice of Reasons for Refusal (Office Action prior to the receipt of Decision to Grant a Patent) for the related JP application 2020-500669 dated May 25, 2020.

* cited by examiner

HAND-HELD MEMBER AND HAND-HELD-TYPE ARTICLE

TECHNICAL FIELD

The present disclosure relates to a hand-held member including a portion to be held by hand, and a hand-held-type article.

BACKGROUND ART

Hand-held-type articles including: a container (a so-called mug bottle, or the like) having a space for containing liquid such as a beverage; a knife such as a kitchen knife; various kinds of tableware; and the like are often used in daily life. The hand-held-type article has, for example, a main body having a function such as storing a liquid, and a hand-held part joined adjacent to the main body. When a user holds the hand-held part to hold the article, an operation such as putting a beverage or the like in and out of a container, cutting foodstuff with a kitchen knife, or the like is performed, and a function as the article is realized.

RELATED ART DOCUMENT

Patent Document

Patent Document 1: Japanese Unexamined Utility Model Application Publication No. S62-159854

Patent Document 2: Japanese Unexamined Patent Publication No. 2004-358069

SUMMARY OF THE INVENTION

A hand-held member of an embodiment of the present disclosure includes: a hand-held part main body; and a covering material that includes a resin material having viscoelasticity in a temperature range of 10 to 40° C. and covers the hand-held part main body, in which a dynamic friction coefficient of a surface portion of the covering material to a user's finger in contact with an exposed surface of the covering material displaced from a stationary state has a region where the dynamic friction coefficient increases in proportion to the displacement amount of a user's finger from a stationary state, and indicates a maximum value when the displacement amount of the user's finger from the stationary state is a width of the finger.

A hand-held-type article of an embodiment of the present disclosure includes: a hand-held member having the above configuration; and a main body that is joined adjacent to the hand-held member and functions when the hand-held member is gripped.

EMBODIMENTS FOR CARRYING OUT THE INVENTION

Hereinafter, a hand-held member and a hand-held-type article according to an embodiment of the present disclosure will be described with reference to the accompanying drawings. The figures used in the following description are schematic, and dimensional ratios and the like on the drawings do not always match the actual ones. Distinction between the top and bottom in the following description is for convenience, and does not specify the top and bottom when the hand-held member or the hand-held-type article is actually used.

First Embodiment

Figure 1:
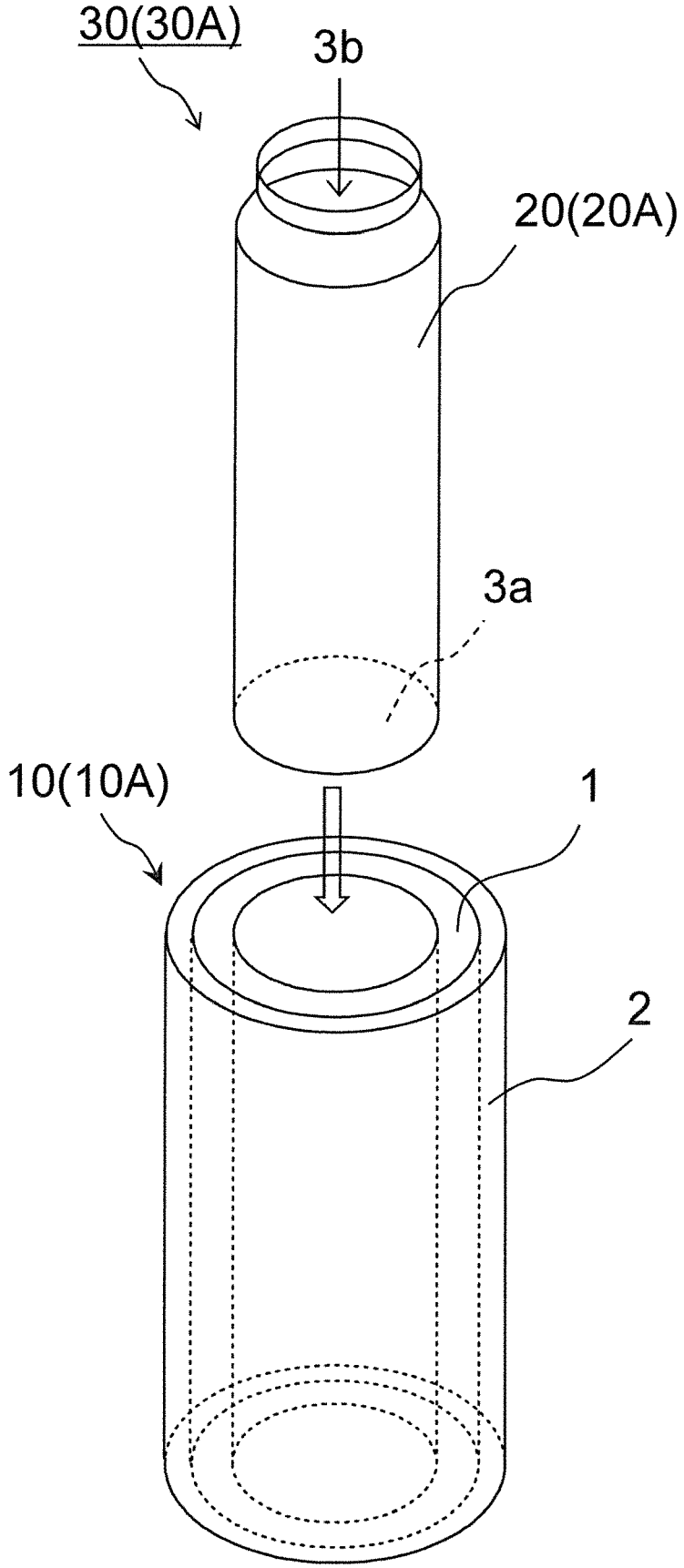
FIG. 1 is an exploded perspective view of a hand-held-type article including a hand-held member according to a first embodiment of the present disclosure.
Figure 2A:
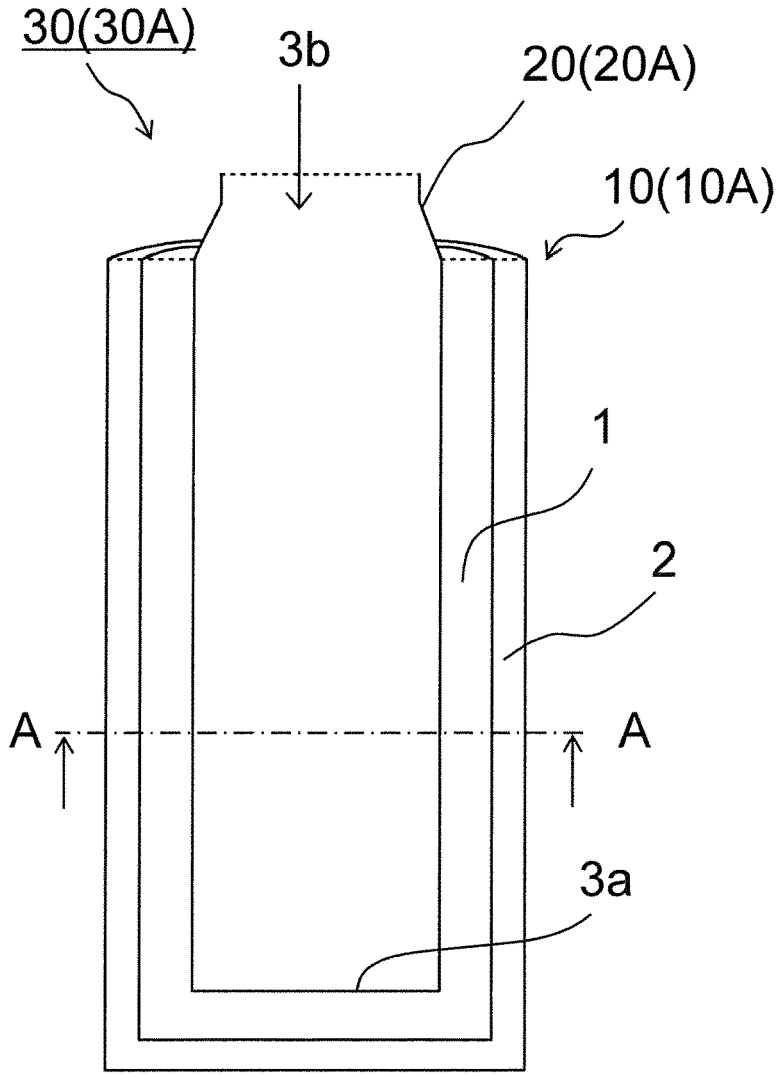
FIG. 2A is a cross-sectional view showing the hand-held-type article of FIG. 1 cut in a length direction of a main body.

FIG. 1 is an exploded perspective view of a hand-held-type article including a hand-held member according to a first embodiment of the present disclosure. FIG. 2A is a cross-sectional view showing the hand-held-type article of FIG. 1 cut in a length direction of a main body, and FIG. 2B is a cross-sectional view taken along line A-A of FIG. 2A.

Figure 2B:
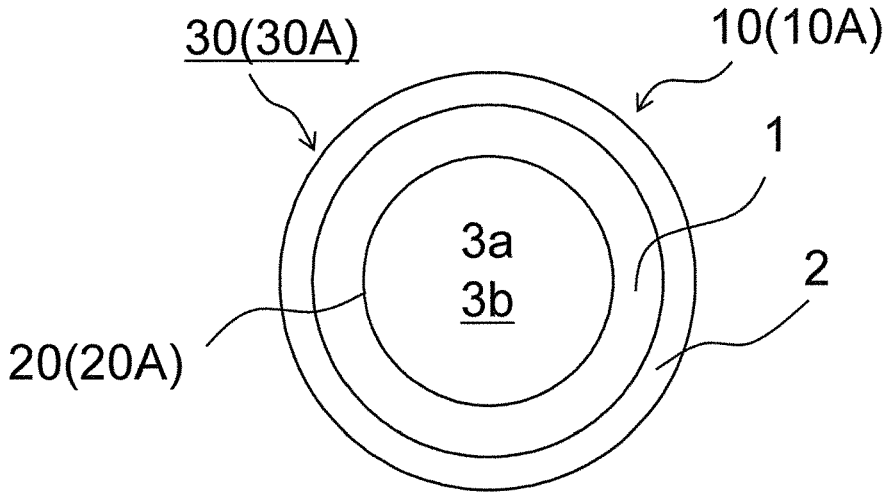
FIG. 2B is a cross-sectional view taken along line A-A of FIG. 2A.

In the examples shown in FIGS. 1, 2A, and 2B, a hand-held member 10 covers an outer periphery of a main body 20 of a hand-held-type article 30. The main body 20 of the hand-held-type article 30 is a tubular container (hereinafter, also referred to as a container 20A). The hand-held-type article 30 (hereinafter, simply referred to as an article 30A) in this example in which the container 20A has an opening 3*b* for the liquid inlet/outlet on one side and has a bottom part 3*a* on a side opposite to the opening 3*b* is, for example, a container that stores various kinds of beverage while keeping temperature. The opening 3*b* described above is closed with a lid material (a so-called cap) (not shown) of a fitting type, a screw type, or the like, for example. As a result, an inside of the container 20A is hermetically sealed, and liquid such as a beverage is stored in a watertight state.

The container 20A is made of a metal material such as, for example, stainless steel. The container 20A may have a double wall structure with a vacuum portion sandwiched in between. In this case, heat transfer inside and outside the container can be effectively reduced. The article 30A is used as a mug bottle, a thermos bottle, or the like suitable for keeping temperature of a beverage. The article 30A provided with such a container 20A includes vacuum double molded products, for example, which are wide-mouthed bottles such as a mug bottle and a soup jar, tumbler-shaped cups, and the like.

The hand-held member 10 (10A) covers an outer periphery of the main body 20 where the article 30A is held by a user's hand. The hand-held member 10A in this case has a function of reducing a slip of fingers when the article 30A is gripped and held. The hand-held member 10A has a function of increasing a friction coefficient of a surface portion of the article 30A such as a mug bottle, as compared to a friction coefficient of a surface of the main body (container) 20A.

A hand-held part main body 1 is a portion that is in direct contact with an outer surface of the article 30A and is joined to the outer surface. Therefore, the hand-held part main body 1 is formed of a material that facilitates joining to the main body of the article 30A and makes it easy to secure joining strength. The hand-held part main body 1 is formed of a material that facilitates attachment of a covering material 2 to a surface of the hand-held part main body 1 and also makes it easy to improve strength of the attachment. Examples of such a material for forming the hand-held part main body 1 include polyolefin resin such as polypropylene resin and polyethylene resin, and resin materials such as polyester resin and vinyl resin.

The covering material 2 covers the surface of the hand-held part main body 1 as described above. An outer surface of the covering material 2 is in direct contact with the user (fingers, and the like). The covering material 2 contains a resin material having viscoelasticity in a temperature range of 10 to 40° C. An outer surface portion of such a covering material 2 exhibits viscoelasticity in the temperature range described above.

The temperature range described above is the same as or approximated to a temperature of the covering material 2 when the user's fingers or the like come into contact with the covering material 2 to use the article 30A. Therefore, when the user starts using the article 30A, the covering material 2 behaves as an elastic body. Further, with the use of the article 30A, the covering material 2 behaves as a viscous body.

From the viewpoint of the user for this, when starting to use the article 30A (for example, when holding a mug bottle of the article 30A relatively strongly), the user can easily grip the article 30A through the covering material 2 that behaves as an elastic body. As the article 30A is continuously used (when a force is continuously applied to the covering material 2), an elastic modulus of the covering material 2 that behaves as a viscous body gradually becomes smaller. That is, a force of the covering material 2 to repel the gripping force tends to be small. Therefore, a burden on the user holding the article is also reduced. Further, the covering material 2 is minutely deformed easily. Therefore, also when a way of holding the article 30A is changed (such as when a holding position is changed), the covering material 2 is slightly deformed in accordance with a position of the finger, and the gripping of the article 30A through the covering material 2 can be easily continued.

Such a covering material 2 has an elastic modulus of about 100 to 500 MPa, for example, when behaving as an elastic body.

The covering material 2 can be formed of a material containing at least one selected from resin materials such as, for example, urethane resin, (meth) acrylic resin, and polyolefin resin. The covering material 2 may be a material in which these resin materials are mixed, or may be a copolymer. Details of the covering material 2 will be described later. The (meth) acrylic resin means acrylic resin or methacrylic resin.

The hand-held member 10 can be produced, for example, as follows. First, a base material for the container 20A or the like (for example, a stainless steel container of a mug bottle) of the article 30A is prepared. A thickness of the stainless steel of the container 20A is set to, for example, about 0.25 to 0.3 mm.

Next, polypropylene resin powder or the like is caused to adhere to an outer surface of the base material for the container 20A, and then the polypropylene resin or the like is heated to be softened and adhere to the surface of the base material, to form the hand-held part main body 1.

After that, a resin material to be the covering material 2 is applied to an outer surface of the hand-held part main body 1, and this is heated and cured to form the covering material 2.

By the above steps, the hand-held member 10 that covers the outer surface of the container 20A of the article 30A can be produced.

The above base material is not limited to the container 20A. For example, a metal mold for molding similar to the container 20A may be prepared, and this metal mold may be used to mold the resin material that is to be the covering material 2. In this case, the container 20A is fitted into the hand-held member 10 prepared as a separate part from the container 20A, and the article 30A is manufactured.

A thickness of the hand-held part main body 1 with respect to the outer surface of the stainless steel container and the like (container 20A) can be appropriately set in accordance with conditions such as a material, workability at a time of formation, strength of joining to the container 20A, and economic efficiency. For example, when the article 30A is a mug bottle, a thickness of the hand-held part main body 1 may be about 0.3 to 0.4 mm.

A thickness of the covering material 2 can be appropriately set in accordance with conditions such as a material, workability at a time of formation, strength of joining to the hand-held part main body 1, and economic efficiency. For example, when the hand-held part main body 1 is made of polypropylene resin, and the covering material 2 is made of a resin material containing urethane resin, the thickness of the covering material 2 may be about several tens of μm, and may be about 20 to 30 μm, as an example.

The covering material 2 may have a region in which a dynamic friction coefficient of a surface portion with respect to an external member that is in contact with an exposed surface and is displaced from a stationary state is increased in proportion to a displacement amount of the external member from the stationary state. The external member is, for example, a user's finger, a user who tries to lift a mug bottle, or the like. That is, the covering material 2 has a region of a displacement amount of the fingers in which the fingers in contact with the outer surface is temporarily less likely to slip.

Therefore, when the covering material 2 is formed on the outer surface of the hand-held part main body 1, for example, it is possible to effectively reduce a possibility of accidentally slipping off the article 30A or spilling liquid such as a beverage stored in the container 20A. That is, the hand-held member 10A can be made to be effective in improving ease of handling, such as practicality, safety, and the like of the article 30A.

The dynamic friction coefficient on the exposed surface of the covering material 2 with respect to the external member can be adjusted within a predetermined range, for example, by adjusting a viscosity, a softening temperature, surface roughness, and the like of the covering material 2 when behaving as a viscous body. For example, by increasing the viscosity of the covering material 2, by lowering the softening temperature, and by increasing the surface roughness, the dynamic friction coefficient of the covering material can be increased. At this time, by using together a condition (for example, an increase in the viscosity) for further increasing the dynamic friction coefficient with displacement of the external member, it is possible to form the covering material 2 having a region in which the dynamic friction coefficient increases in proportion to a displacement amount of the external member from the stationary state.

Figure 3:
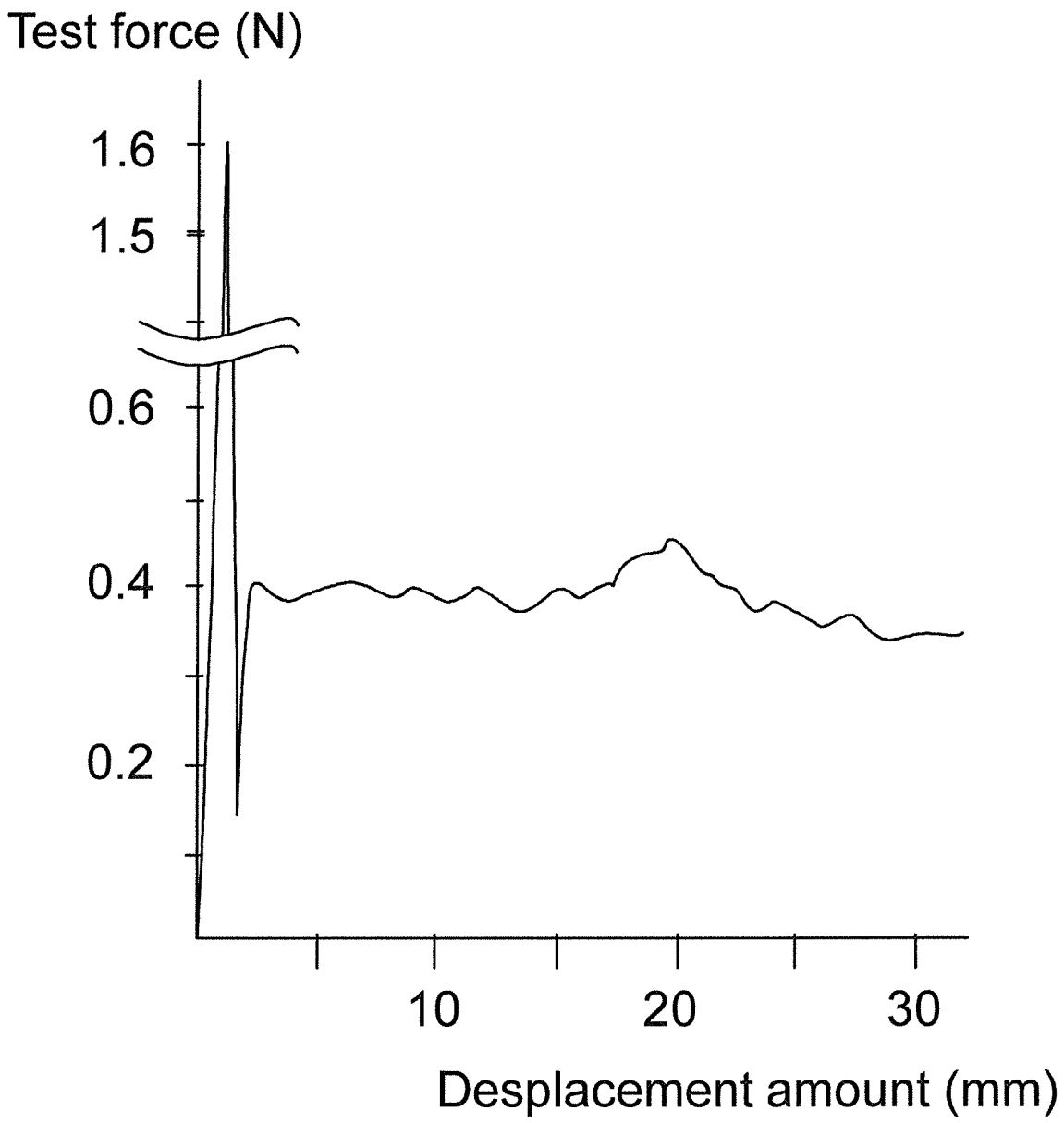
FIG. 3 is a graph showing a friction coefficient of a covering material in a hand-held member according to an embodiment of the present disclosure.

FIG. 3 is a graph showing a friction coefficient of the covering material 2 in the hand-held member 10 (10A) of an embodiment of the present disclosure. The friction coefficient has been obtained by measuring a test force in a tensile mode, by using, as a test piece, a resin material piece having the same composition as that of the covering material 2 of the embodiment. A load (normal reaction) by the test piece has been set to 200 gf (about 1.96 N), and a force applied to the test piece corresponding to a displacement amount (mm) has been measured as a test force (N) and graphed. A dynamic friction coefficient has been calculated by a formula: test force/(average value of displacement amount). As shown in this graph, it can be seen that, for example, in a range of the displacement amount of about 15 to 20 mm, the test force increases in proportion to the displacement amount, and the dynamic friction coefficient also increases.

As described above, the dynamic friction coefficient of the surface portion of the covering material 2 with respect to the external member increases in proportion to the displacement amount of the external member. This dynamic friction coefficient may indicate a maximum value when the displacement amount of the external member from the stationary state is a width of a user's finger. The width of the finger is, for example, about 15 to 25 mm.

In this case, for example, when the user's finger accidentally starts slipping against the covering material 2, the dynamic friction coefficient can be increased in an initial stage, to reduce the above-mentioned slip. Even when the user intentionally moves (displaces) the finger with respect to the covering material 2, it is also possible to effectively reduce a possibility that the hand-held part of the article 30A covered with the covering material 2 will move (slip) beyond the user's intention.

In this case, the increasing frictional force is within a range of increase in the dynamic friction coefficient, which is very small as compared to a maximum static frictional force. Therefore, a possibility that the user feels difficult to move when moving the finger with respect to the covering material 2 is effectively reduced, which improves practicality such as ease of handling.

Such adjustment of the dynamic friction coefficient can be performed by, for example, the above-mentioned method of viscosity adjustment or the like of the covering material 2. In this case, the covering material 2 may be a resin material containing urethane resin. The covering material 2 containing urethane resin may further contain (meth) acrylic resin. The (meth) acrylic resin means acrylic resin or methacrylic resin. The covering material 2 may be a resin material containing a copolymer of urethane and (meth) acrylic. In this case, a molecular chain forming the resin material has a urethane-bonded portion and an acrylic-bonded portion. A weight average molecular weight of the molecular chain forming such a resin material is set to, for example, about 5,000 to 50,000. This makes it possible to easily adjust the dynamic friction coefficient as the covering material 2, while ensuring mechanical strength of the covering material 2.

When the covering material 2 is a resin material containing urethane resin and (meth) acrylic resin, the covering material 2 having viscoelasticity as described above can be easily manufactured. It is also easy to increase the dynamic friction coefficient on the surface of the covering material 2 in response to displacement of the external member as described above.

That is, urethane resin and (meth) acrylic resin can easily have a composition in which a glass transition point is lower than 10° C. and a softening point exceeds 40° C., which facilitates formation of the covering material 2 having viscoelasticity at 10 to 40° C.

Urethane resin has a relatively small elastic modulus of about 600 to 1000 MPa, and has so-called elasticity and an elastic recovery function (a restoring force). Therefore, as described above, it is easy for the dynamic friction coefficient of the outer surface to increase in response to displacement of the external member. In this case, the surface portion of the covering material 2, which is easily deformed, is also slightly deformed in accordance with displacement of the external member. The elastic recovery of the urethane resin acts on this deformation. A stress acting on the external member from the covering material 2 at a time of elastic recovery causes an action of suppressing displacement of the external member to some extent. This makes it easy to obtain the covering material 2 in which the dynamic friction coefficient of the outer surface increases in response to displacement of the external member.

When the covering material 2 is a resin material containing urethane resin, the above-mentioned elastic recovery action can also recover deformation erroneously generated on the outer surface of the covering material 2, to a state before the deformation. That is, the covering material 2 can be provided with a self-repairing function. The above deformation that occurs on the surface of the covering material 2 is a scratch, a dent, or the like that occurs, for example, when the covering material 2 located on an outermost surface of the article 30A accidentally comes into contact with the user, various utensils, metal members (a fastener held by the user, and the like), outdoor objects, and the like. A function of repairing/restoring such deformation can be effectively enhanced by further containing (meth) acrylic resin in the covering material 2.

A thickness of the covering material 2 is set to 20 μm or more in consideration of ensuring the above-mentioned deformation repairing function in the covering material 2. The thickness of the covering material 2 is set to 20 μm or more and 30 μm or less in consideration also of strength of joining of the covering material 2 to the hand-held part main body 1, workability, productivity, and the like.

A resin material having such a self-repairing function has, for example, the following composition. That is, urethane resin has a composition obtained by polymerizing isocyanate such as diisocyanate with a polyol such as ethylene glycol or polycarbonate diol, and has urethane bonding in a molecular chain. The urethane resin in this case may be copolymerized with an acrylic material such as methyl acrylate or methyl methacrylate.

(Meth) acrylic resin is obtained by bonding, in a chain, polymerization units of methyl acrylate, methyl methacrylate, or the like, and has a composition containing a polymer chain of methyl acrylate, methyl methacrylate, or the like. In this case, the covering material 2 is formed of a material containing a copolymer of methyl acrylate or methyl methacrylate and the urethane resin.

The urethane resin and the (meth) acrylic resin may further contain another resin material such as, for example, silicone resin or fluororesin, and may be a copolymer with any one of those resin materials. Filler particles made of an inorganic material such as silica may be added to the urethane resin and the (meth) acrylic resin.

As described above, the article 30 is basically formed by the hand-held member 10 of the embodiment including the first embodiment, and the main body 20 joined adjacent to the hand-held member 10. The main body 20 realizes functions of storing liquid, keeping temperature, and the like when the hand-held member 10 is gripped. In the first embodiment, the main body 20 is a tubular container in which one opening 3*a* is closed, and the hand-held member 10A covers an outer periphery of the container (main body 20).

According to such a hand-held-type article 30 (30A) of the embodiment of the present disclosure, the covering material 2 located on an outermost surface of the hand-held member 10 (10A), which is a handle portion, has the above-described configuration. Therefore, it is possible to provide the hand-held-type article 30 (30A) such as a liquid container (a mug bottle) that facilitates improvement of ease of handling, such as the difficulty of slipping the fingers on the hand-held member and ease of displacement.

Second Embodiment

Figure 4A:
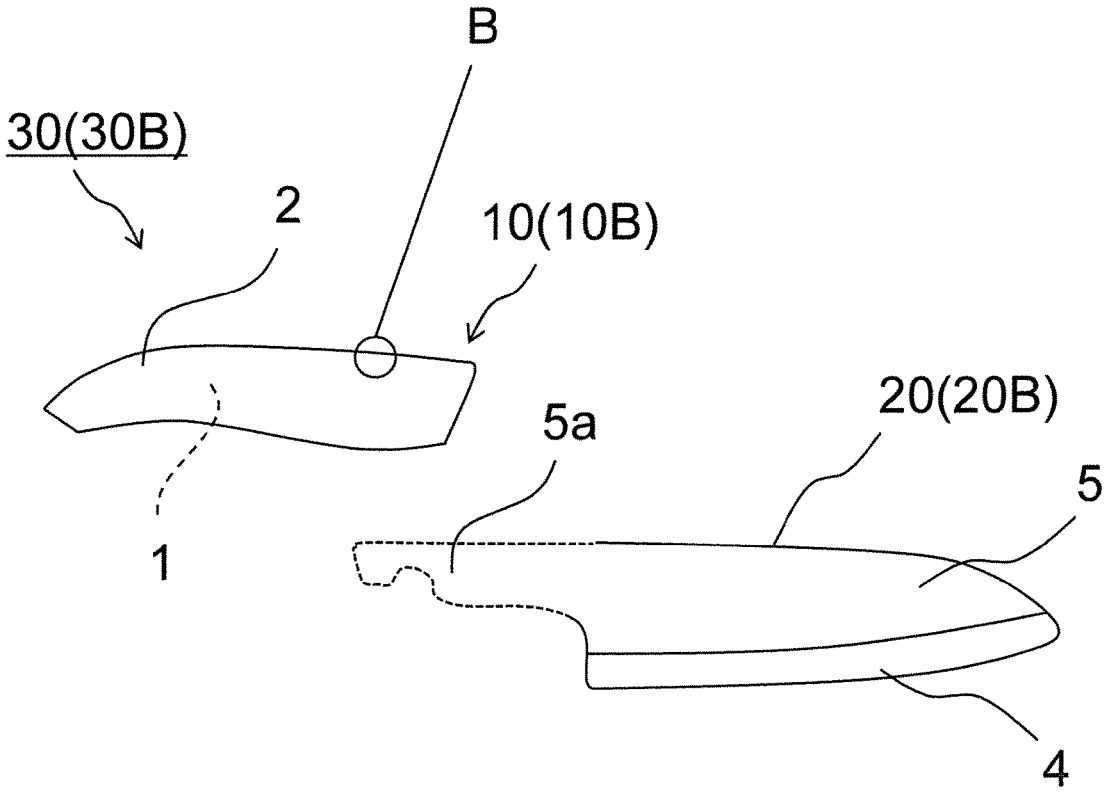
FIG. 4A is exploded plan view showing a hand-held-type article including a hand-held member according to a second embodiment of the present disclosure.
Figure 4B:
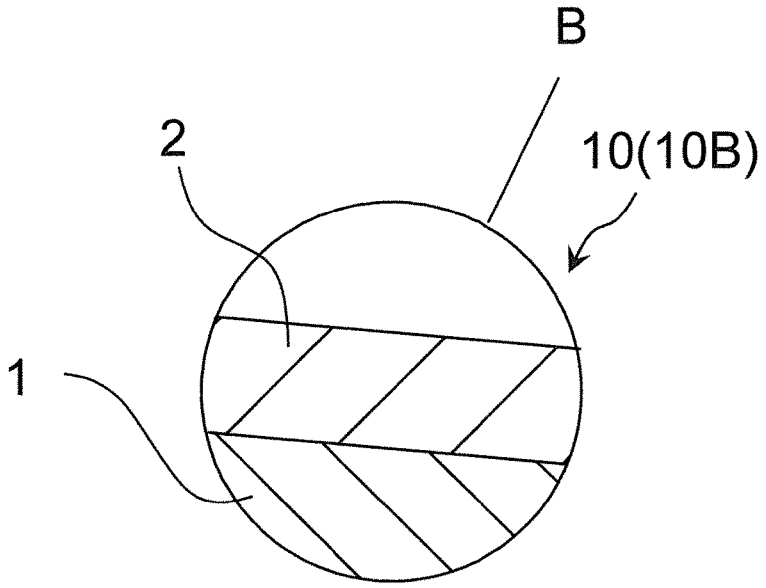
FIG. 4B is an enlarged cross-sectional view showing a cross section of a portion B of FIG. 4A.
Figure 5:
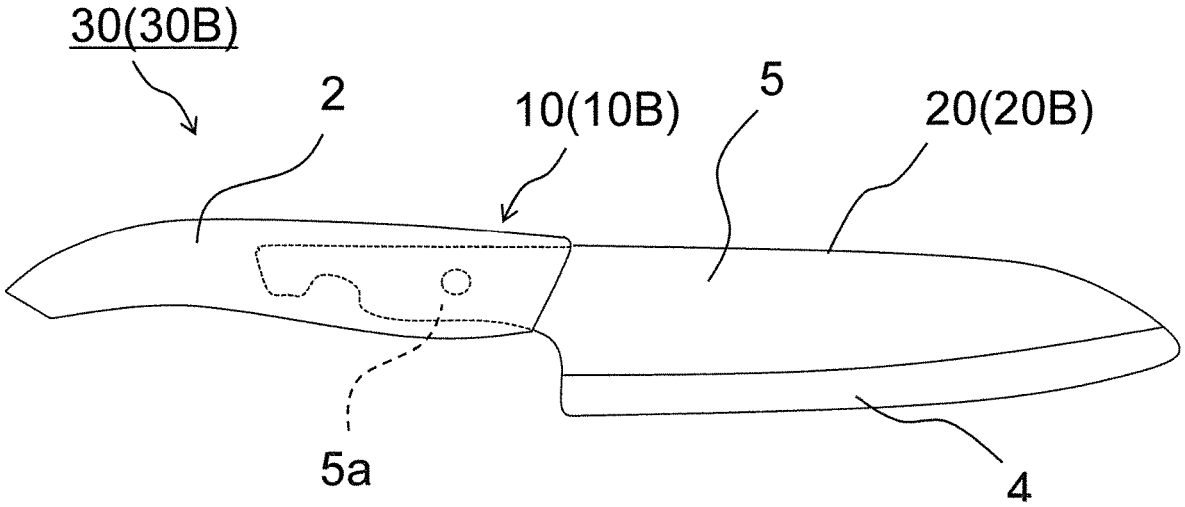
FIG. 5 is a transparent plan view showing the hand-held-type article of FIG. 4A.

FIG. 4A is an exploded plan view showing a hand-held-type article 30 (hereinafter, also simply referred to as an article 30B) including a hand-held member 10B according to a second embodiment of the present disclosure. FIG. 5 is a transparent plan view of the hand-held-type article 30 (not exploded) of FIG. 4A. FIG. 4B is a cross-sectional view showing a cross section of a portion B of FIG. 4A.

The second embodiment differs from the first embodiment in that the article 30B is a knife such as a kitchen knife. Also in the second embodiment, a point that the hand-held member 10B covers an outer surface of a main body in a handle portion of the article 30B is similar to the case of the first embodiment. The point that the hand-held member 10B has a hand-held part main body 1 and a covering material 2 arranged in order from a main body 20B side as shown in the example shown in FIG. 4B is also similar to the case of the first embodiment. Note that reference numeral 1 indicated by a broken line leader in FIG. 4A indicates that the hand-held member 10B internally has the hand-held part main body 1 whose surface is covered with the covering material 2.

The main body 20 of the article 30B in this form is a blade 20B including a base part 5 in which a blade part 4 is located at one end (hereinafter, also referred to as a blade 20B). The hand-held member 10 covers a portion (so-called core) 5*a* of the base part 5 located outside the blade part 4. The hand-held member 10 (10B) in this form is, for example, a haft of a kitchen knife (hereinafter, also referred to as a haft 10B). The second embodiment is similar to the first embodiment except that the forms of the article 30B and the haft 10B are different as described above.

The blade 20B is formed of a ceramic material, a metal material, or the like. Examples of the ceramic material include zirconium oxide, a composite material containing zirconium oxide as a main component, and the like. When the blade 20B is made of the ceramic material, the article 30B is a so-called ceramic kitchen knife.

In the blade 20B, the blade part 4 is a part that actually cuts an object such as foodstuffs and the like. The zirconium oxide, which is a main material, may contain particles whose main component is a material having a Vickers hardness higher than that of the zirconium oxide. A material forming the particles is, for example, aluminum oxide or a ceramic material containing aluminum oxide as a main component.

A shape and dimensions of the blade 20B are appropriately set in accordance with the use of the article 30B. A specific shape of the blade 20B may be set to a shape such as, for example, a Japanese kitchen knife such as a broad-bladed kitchen knife or a Santoku knife, a Western kitchen knife such as a chef's knife, or a Chinese kitchen knife. The blade 20B does not have to be limited to a shape of a kitchen knife, and may have a shape of, for example, a knife, a surgical instrument, or the like. Further, a shape and dimensions of the core 5*a* may also be appropriately set in accordance with the use of the article 30B such as a ceramic kitchen knife. A hole 5*b* may be located in the core 5*a*. By inserting a part of the hand-held part main body 1 into the hole 5*b*, a possibility that the blade 20B will come off from the haft 10B is reduced.

The hand-held part main body 1 and the covering material 2 included in the hand-held member 10B in the second embodiment are formed of a material similar to that of the hand-held part main body 1 and the covering material 2 included in the hand-held member 10A in the first embodiment. That is, the covering material 2 located on an outermost surface of the haft 10B has viscoelasticity as described above. This covering material 2 may have a dynamic friction coefficient as described above.

Therefore, for example, in cutting an object by using the kitchen knife of the article 30B, the user's fingers are less likely to slip against the haft 10B. This makes it possible to improve ease of use such as cutting workability of a kitchen knife or the like that is a hand-held-type article 30B.

Further, for example, even when a holding position of the haft 10B of the article 30B is slightly changed in order to make it easier to cut foodstuffs and the like with the blade part 4, it is possible to easily change the holding position while reducing the slip of the fingers against the viscous haft 10B. Therefore, it is possible to provide a kitchen knife or the like that is advantageous for improving a characteristic such as ease of use.

In a case where the article 30B is a ceramic kitchen knife, the hand-held member 10B and the article 30B of the second embodiment can be manufactured as follows, for example.

First, the blade 20B is prepared. For the blade 20B, alumina powder is added to zirconia powder containing, for example, yttria powder of several mol % or less, and an appropriate organic resin binder is added to make granules. The obtained granules are molded like the blade 20B by using a molding method such as metal molding, and then sintering is performed to obtain a zirconia sintered compact. The obtained zirconia sintered compact is edged by a usual method, and the blade 20B is obtained. The edging is set so as to obtain a predetermined blade edge angle. A sintering temperature may be appropriately set in accordance with the material, for example, 1300° C. or higher and 1700° C. or lower. By polishing one end portion of the produced blade 20B, the blade part 4 can be formed. This allows the base part 5 including the blade part 4 and the core 5*a* to be produced.

After that, similarly to the case of the first embodiment, a resin material such as polypropylene resin as the hand-held part main body 1 and a resin material such as urethane resin as the covering material 2 are sequentially attached on an outer surface of the core 5*a* part in the base part 5 of the blade 20B where the blade part 4 is not located. By the above steps, the hand-held member 10B and the hand-held-type article 30B according to the second embodiment can be manufactured.

According to the hand-held-type article of the embodiment of the present disclosure, it is possible to provide a hand-held-type article that facilitates ease of handling in a hand-held member that is a part to be held by hand.

Although the embodiments of the present disclosure have been described above, the present disclosure is not limited to the above-described embodiments, and various kinds of enhancement and improvement are possible within the scope of the claims. For example, the hand-held member 10 may be colored by adding a coloring material such as a dye to the hand-held part main body 1 or the covering material 2.

A light (visible light) reflectance of the covering material 2 may be about 70 to 80% or more on the outer surface portion, and may be more than that, for example, 90% or more. In this case, especially when the reflectance is 90% or more, an appearance of the covering material 2 becomes vivid, which is effective for improving decorativeness in appearance. This can improve decorativeness of the article 30 (30A, 30B), and can also increase an added value. For example, when the article 30 is displayed and sold together with the same type of product, it can be expected to have an effect such as easily attracting attention of purchasers.

The covering material 2 having a light reflectance of about 70 to 80% or more on the outer surface portion contains, for example, (meth) acrylic resin as described above. In this case, due to a light transmission effect of the (meth) acrylic resin and a light reflection effect of other component such as urethane resin, incident light can be reflected over a relatively wide range in a thickness direction of the covering material 2. Therefore, the covering material 2 is easily made to have a light reflectance of about 70 to 80% or more on the outer surface portion.

DESCRIPTION OF THE REFERENCE NUMERAL

1: Hand-held part main body
2: Covering material
3*a*: Bottom part
3*b*: Opening
4: Blade part
5: Base part
5*a*: Core
10: Hand-held member
10A: Hand-held member
10B: Hand-held member (haft)
20: Main body
20A: Main body (container)
20B: Main body (blade)
30: Hand-held-type article
30A: Article (mug bottle)
30B: Article (kitchen knife)

The invention claimed is:

1. A hand-held member comprising:

a hand-held part main body having a longitudinal length from one end to an opposing end; and a covering material covering the hand-held part main body, the covering material including a resin material formed from a molecular chain that has a urethane-bonded portion and an acrylic-bonded portion, the molecular chain having a weight average molecular weight between 5,000 and 50,000 in the resin material, such that the resin material has viscoelasticity in a temperature range of 10 to 40° C. and a value of a dynamic friction coefficient of a surface portion of the covering material to a finger in contact with the surface portion increases, in proportion to a displacement amount of the finger from a stationary state along the longitudinal length of the hand-held part main body, to a peak value when the displacement amount is at a point within a range of 15 to 25 millimeters.

2. A hand-held-type article comprising:

the hand-held member according to claim 1; and a main body that is joined adjacent to the hand-held member and functions when the hand-held member is gripped.

3. The hand-held-type article according to claim 2, wherein the main body is a container having a tubular shape with one opening closed, and the hand-held member covers an outer periphery of the container.

4. The hand-held-type article according to claim 2, wherein the main body is a blade having a blade part and a base part in which the blade part is located at one end, and the hand-held member covers a portion of the base part located outside the blade part.

* * * * *